United States Patent [19]

Rayburn et al.

[11] 4,128,387

[45] Dec. 5, 1978

[54] IGNITION DEVICE

[75] Inventors: Billy R. Rayburn, Rossmore; Alfred F. Hayes, Anaheim, both of Calif.

[73] Assignee: Paul T. Mu, Monterey Park, Calif.; a part interest

[21] Appl. No.: 735,027

[22] Filed: Oct. 22, 1976

[51] Int. Cl.[2] ..... F23N 5/20

[52] U.S. Cl. ..... 431/78; 431/69

[58] Field of Search ..... 431/71, 80, 78, 27, 431/69

[56] References Cited

U.S. PATENT DOCUMENTS

| | | | |
|---|---|---|---|
| 3,832,123 | 8/1974 | Walbridge | 431/78 |
| 3,840,322 | 10/1974 | Cade | 431/78 |
| 3,847,533 | 11/1974 | Riordan | 431/78 |
| 3,947,220 | 3/1976 | Dietz | 431/80 |
| 4,019,854 | 4/1977 | Carlson et al. | 431/80 |

*Primary Examiner*—Edward G. Favors

*Attorney, Agent, or Firm*—William C. Babcock

[57] ABSTRACT

A control circuit for use with spark ignition system disposed in a gas burner comprising a high voltage pulse circuit for developing the spark which is gated by a flame sensor. That same flame sensor also controls a timing and latch circuit connected to initially open the gas flow to the burner and to close such gas flow if burning is not established within a predetermined interval of time. The timing and latch circuit also includes components which after an unsuccessful start-up preclude further starting cycles until manual intervention takes place and control all failure modes to a shut-down condition.

8 Claims, 3 Drawing Figures

G
11
12
10
13
14
15
20
D
25
26
50
TIMER & THERMO STAT
T
S2
S1
P
E

FLAME ON
SENS 25
153
IGINTE
COIL 81
152
FLAME NOT ON
NO FLAME & 82 CLOSED
151
82 CLOSED
95 CHARGED
START
CAP 95
154

IGNITION DEVICE

BACKGROUND OF THE INVENTION

1. Field of the Invention

The present invention relates to ignition devices, and more particularly to electrically powered gas burner igniters.

2. Description of the Prior Art

With the present day shortages of energy and particularly the present radical shortages in gas reserves, the requirement of economy in gas usage has risen to paramount importance. One major overhead item incidental to some gas burning devices is that required to maintain the pilot light for ignition. To avoid the uneconomical features of the pilot light various devices have been developed in the past which through momentary application of electrical energy ignite the burner on demand. Most such electrical igniters were of the heating filament type, wherein a heating filament would be used to ignite a pilot or preignition circuit and only after the pilot is ignited is the main burner enabled. The complexity of the foregoing ignition systems has been a continuous source of failures, with the result that the home user would often be required to maintain various small components in any gas burning appliance in order to keep it working. Also extensive component redundancy was required to insure fail-safe conditions.

Alternatively spark ignition systems for use with gas burners were developed where, for example, a spark would be generated during the start-up period of the burner to ignite the gas. Most such prior spark ignition systems, however, are again quite complex to assure safe failures. In each instance breakdowns are accompanied by the potential for repeated high volume gas flows. It is this specific problem that is currently addressed by the present invention.

SUMMARY OF THE INVENTION

Accordingly it is the general purpose and object of the present invention to provide a gas burner ignition circuit wherein a failure to establish burn within a predetermined interval of time will require manual intervention in order to enable a next start attempt.

Further objects of the invention are to provide a spark ignition system for gas burners which concurrently serves the function of monitoring both the burn and the electric power to effect a shut down if the burner is inadvertently extinguished.

Yet further objects of the invention are to provide a burner ignition system wherein manual intervention is required after an unsuccessful ignition attempt.

Other objects of the invention are to provide an ignition system for gas burners which can be conveniently retrofitted into various gas burning appliances now in use.

Yet further objects of the invention are to provide a gas burner ignition system which utilizes the conventional home current in its operation and which furthermore because of minimum critical parts can be controlled to fail-safe modes.

Briefly these and other objects are accomplished within the present invention by combining a conventional spark igniter and a flame sensor with an inventive control system described herein. The control system in turn connects to a redundant set of solenoid valves installed in the main gas supply line, thus controlling the gas flow to the burner both during start and subsequent to ignition. The inventive controller itself receives the AC power across the normally included thermostat and control circuit of the appliance and in series with a manual restart switch. This AC power is applied to the primary of a transformer which across one half of a center tapped secondary drives a high voltage ignition circuit to energize the spark igniter. A third winding on the same transformer is connected on one end to the flame sensor and at the other end both to the enabling terminal of the above summarized high voltage circuit and to a reset terminal of a timing and latch circuit.

While the general functions of the aforementioned flame sensor are known, certain aspects thereof are repeated summarily at this point to complete the description. More specifically the flame sensor utilizes the ionized gases in the flame itself to form a circuit to ground at the burner housing through which current of predetermined polarity will be passed. Thus when the flame is ignited a diode circuit is, in effect, formed between the sensor probe and ground. Once the flame goes out, that diode is opened. This diode principle is utilized during start-up both to terminate or to disable the high voltage circuit and to provide a latching signal to a relay which complete a circuit path to the two redundant solenoids on the gas line. In the event of an inadvertent shut-down that diode path is interrupted, unlatching the relay and closing off the gas supplied. The same timing and latch circuit also includes protection devices in order to avoid any catastrophic conditions. More specifically the relay itself is in series with a solid state device, like, for example, a silicon controlled rectifier the failure thereof being therefore quite critical to the system. In the event that last mentioned device shorts out it is possible to arrive at a condition where the gas valves are on or the gas solenoid is pulled in while no flame is on the burner outlet. To avoid this contingency a fail-safe circuit is provided across the relay winding which in case of a short will burn out the circuit fuses. Thus in the event of a short across the aforementioned SCR which could potentially maintain the valves open, the circuit is disabled. This particular feature provides for a fail-safe condition across the most critical elements in the circuit. In addition all the other failure modes in a circuit are such that any component breakdown, either open or short, will render the system inoperative, and concurrently will close off the redundant solenoid valves on the line.

DESCRIPTION OF THE SPECIFIC EMBODIMENT

While the present description sets forth the inventive control system in an environment of a gas burning appliance, such is exemplary only. It is to be understood that various other burning systems, including systems utilizing liquid fuel, may be adapted for use herewith and no intention to limit the scope of the claims is expressed by this choice of illustrations.

Figures 1, 3:
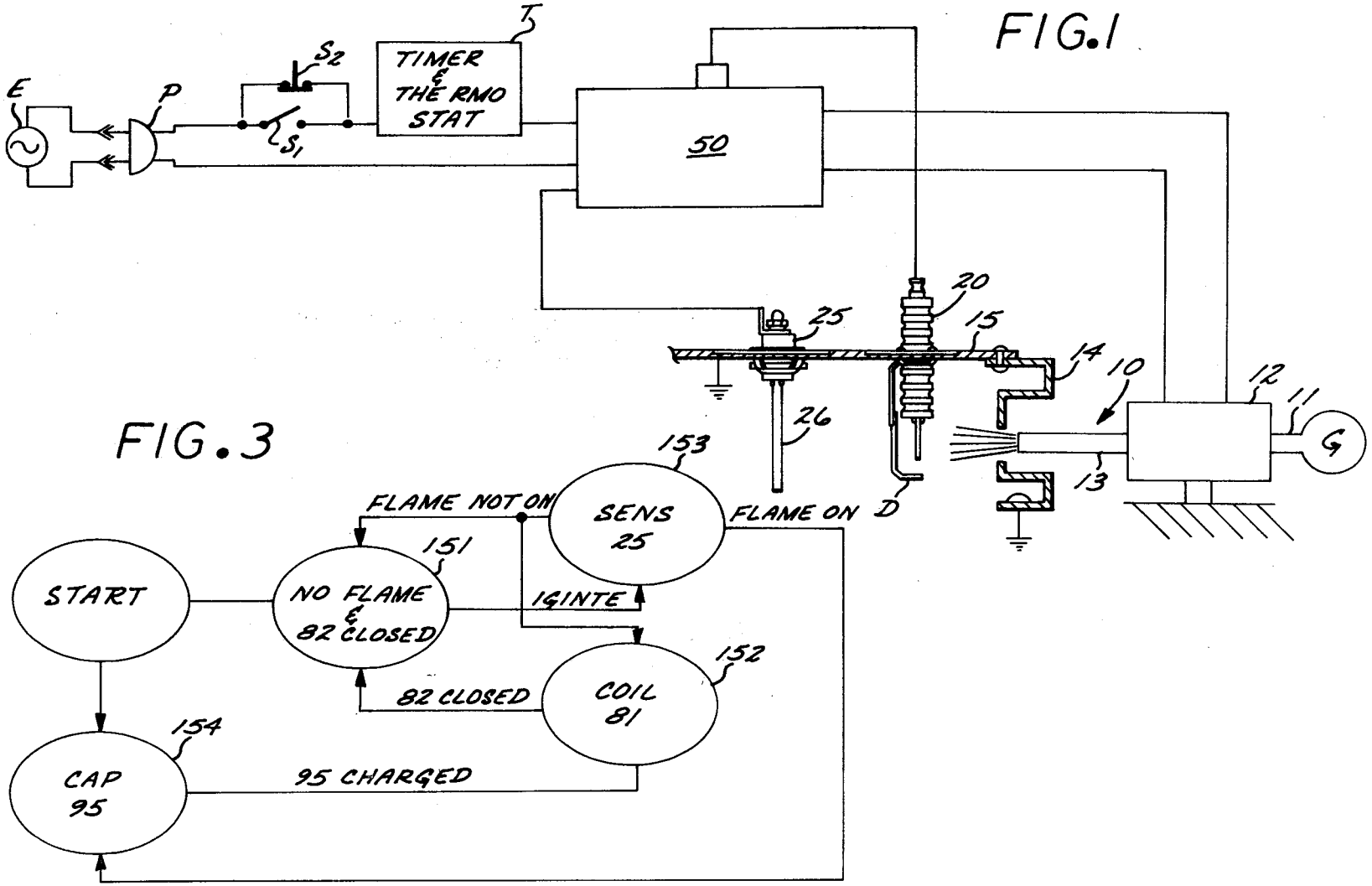
FIG. 1 is a block diagram illustration of an ignition system incorporating a controller constructed according to the present invention.
FIG. 3 is a state diagram illustrating the various modes of failure in the controller described herein.

As shown in FIG. 1 a burner assembly generally designated by the numeral 10 comprises a source of gaseous fuel G which through an inlet pipe 11 connects to the input port of a solenoid valve assembly 12. The output port of valve assembly 12 connects through a burner inlet 13 to a burner orifice assembly 14 at which the flame is established.

Attached on a bracket 15 adjacent the exterior of the orifice assembly 14 is a spark igniter 20 aligned to extend the spark gap thereof into the combustible area of the burner. Igniter 20 is conventional in the art, developing a spark between a center probe and ground. Extending similarly from bracket 15 is a flame sensor 25 aligned to expose a probe 26 into the flame area of the burner. Sensor 25 is again a conventional sensor operating on what is commonly referred to as the flame rectification principle and is symbolically illustrated herein by way of a phantom diode D connected between probe 26 and the orifice assembly 14 as the ground. Whenever a flame is established a rectified conductive path is formed between probe 26 and case ground providing an indication of a burn by way of the signal conducted.

Solenoid valve assembly 12, spark igniter 20 and sensor 25 are all connected to an inventive control unit 50 which also receives an electrical signal E across a wall plug P in series with a door switch $S_1$ (or a manual push-to-start switch $S_2$). The circuit from plug P may also include the conventional timer or thermostat devices T used in various forms in gas burning appliances.

The foregoing description sets forth the environment within which the inventive control system 50 is operating. It is to be noted that the foregoing environment is fully descriptive of either a conventional home appliance like a dryer or a commercial device of special utility. In each case it is the paramount requirement of the burner assembly and any control scheme associated therewith to insure that in case of any failure all gas flow is shut off.

While there have been many various techniques accommodating this fail-safe condition, in most instances such fail-safe features are arrived at through extensive implementation which, in itself, reduces the reliability levels of the control system 50. The presently disclosed control system 50, however, integrally combines most of such fail-safe features in the operating logic with only few additional components inserted to assure safety. The controller configuration, therefore, provides a simple design which concurrently results in a minimal parts count, improving operational reliability.

Figure 2:
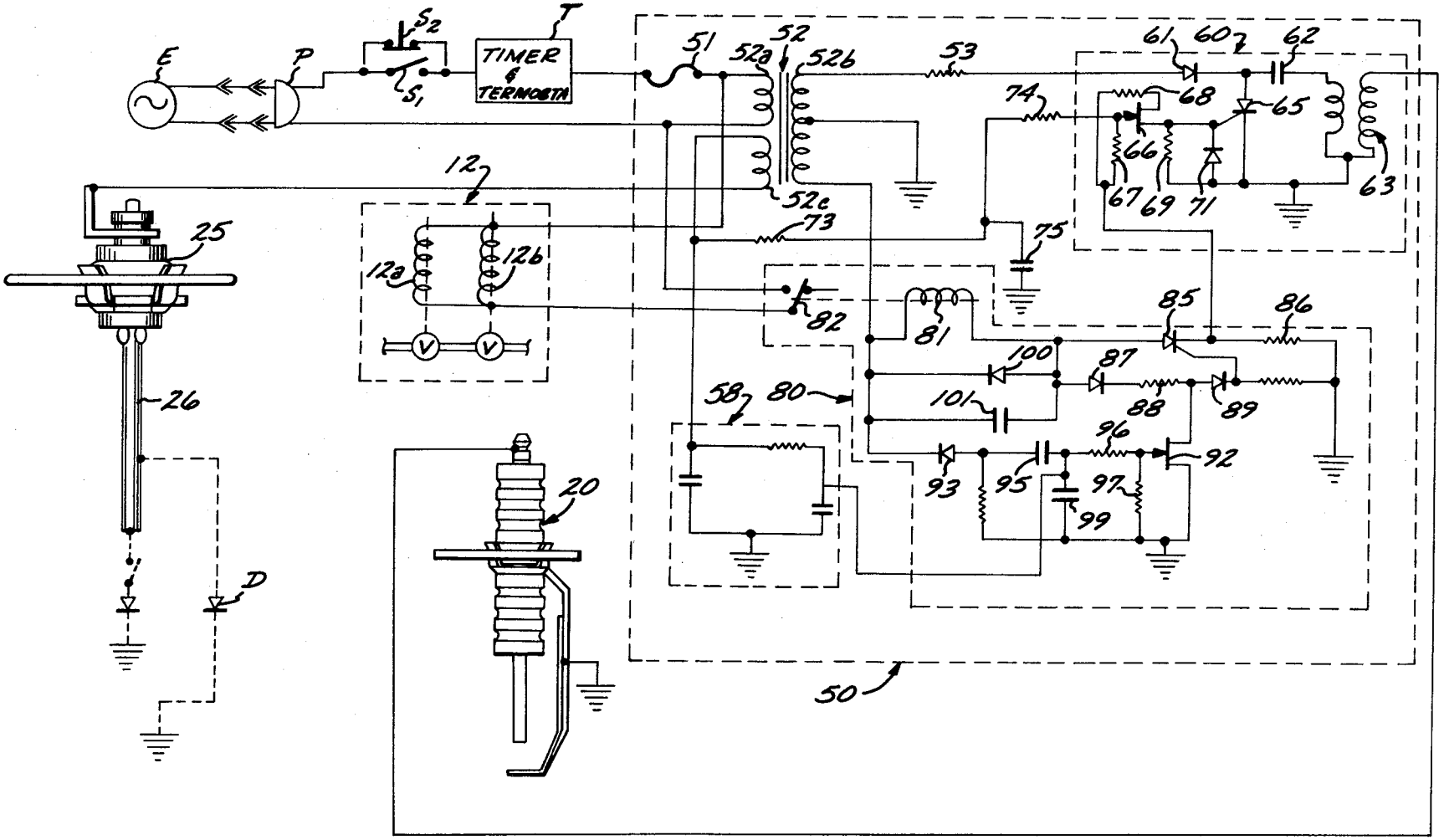
FIG. 2 is a circuit diagram of the inventive controller useful in FIG. 1.

As shown in FIG. 2 the electrical input signal E is applied across a fuse 51 to the primary **52*a* of a transformer 52. Transformer 52 includes a center tapped secondary 52*b*, the upper half thereof being connected to one end of a current limiting resistor 53 at the input of a high voltage capacitive discharge ignition circuit 60. Within circuit 60 the A.C. signal at the output of resistor 53 is rectified by a diode 61 and in this rectified form charges a capacitor 62 connected in series with the primary of a pulse transformer 63 which at its secondary connects to the anode lead of the aforementioned spark igniter 20. Connected across the series circuit comprising capacitor 62 and the primary of transformer 63 is a silicon controlled rectifier 65** which acts as the switch to develop the spark transient which is raised to the necessary sparking voltage by the transformer.

To develop this switching action the gate terminal of the silicon controlled rectifier (SCR) 65 is controlled by a field effect transistor (FET) 66 which, in turn, is controlled in conduction by a signal originating at one end of a third winding **52*c* of transformer 52 and by a biasing network comprising resistors 67 and 68. Resistors 67 and 68 are series connected between the source and gate terminals of FET 66 with the drain terminal developing, in the manner of an emitter follower, the gating signal across a resistor 69 connected between the gate terminal of SCR 65 and ground. A diode 71 connected in parallel across resistor 69** provides additional control over the phasing of this switching input.

Winding **52*c*, at the other end, is connected to the probe 26 terminal of sensor 25 and the ignition of the flame at the burner therefore completes the diode circuit, shown as the phantom diode D, to suppress further switching. In addition a series connection of input resistors 73 and 74 on either side of a capacitor 75** connected to ground control the signal levels attendant with this diode action.

The upper end of winding **52*c* is furthermore connected, across on filter network 58, as a signal input to a latching and timer circuit 80 which is also connected across the lower half of winding 52*b*. More specifically the lower end of winding 52*b* connects to one end of a relay coil 81 which at the other end is connected across a series connection of an SCR 85 and a current limiting resistor 86 to ground. Thus each time SCR 85 is conducting the relay coil 81 is energized to close a spring biased set of relay contacts 82. The closure of contacts 82 completes a circuit across winding 52*a* which excites two parallel solenoid windings 12*a* and 12*b* respectively controlling two series connected valves 12*c* and 12*d* on the gas line 11. Windings 12*a* and 12*b* and valves 12*c* and 12*d* form the aforementioned assembly 12** in a redundant configuration where the failure of one valve is backed up by the second.

The anode to cathode conduction of SCR 85 is controlled by a resistance triggering circuit between the anode and gate terminals. More specifically a series circuit comprising a diode 87, resistor 88, and another diode 89 provides the gating signal developed at the top of a resistor 91 connected to ground. This gating circuit is additionally controlled by a FET 92 disposed between the anode of diode 89 and ground. The conduction of FET 92 is controlled, in turn, by the charge on a capacitor 95 connected across a resistor 96 to the gate terminal. Yet another resistor 97 connected between the gate terminal of FET 95 and ground provides the discharge path, thus setting a time constant within which ignition must occur. Once ignition is established the signal output from filter network 58 maintains FET 92 non-conductive and concurrently maintains the proper charge on capacitor 95.

Capacitor 95 at its other plate is connected to the anode of a diode 93 which at its cathode also connects to the lower end of winding **52*b*. A resistor 94 sets another small leakage path between the anode of diode 93 and ground. Similarly a capacitor 99 floats the juncture of capacitor 95, resistor 96 and the signal output of filter network 58** with respect to ground.

To provide for a logical operative sequence the cathode signal of SCR 85 is fed back to the biasing network around FET 66, i.e., at the juncture between resistors 67 and 68. Thus the source of FET 66 will not be excited until the valve 12 solenoids are pulled in. In the event of a flame out this signal will be maintained for the time interval set by capacitor 95 which is also the interval during which the valve assembly 12 is maintained open. Thus an immediate restart sequence is invoked which if not successful can not be repeated until the power input is manually cycled through one open cycle. This latter condition is imposed by the charge polarity on capacitor 95 which can only be reset after a full power shutdown.

In addition to the above operative components there are two further components added to insure both fail-safe breakdowns as well as clamping and roll off. More specifically a diode 100, in reverse bias with respect to SCR 85, is connected across coil 81, in parallel with a capacitor 101. Thus a short across SCR 85 will entail current levels in winding **52*b* which are sufficiently high to burn the fuse 51**, resulting in a shutdown. The remaining failure modes similarly entail eventual shutdown by virtue of component functions. Thus a control circuit having minimal additional components for fail-safe operation is produced which furthermore is configured to preclude repeated restarts.

The foregoing is illustrated by reference to FIG. 3. As shown in this figure the first state shown as state 151 requires a signal input indicating the contacts 82 are closed which is developed in state mode 152. Mode 152 in turn depends on the state of sensor 25 shown in state 153 and the charge on capacitor 95 shown as state 154. Capacitor 95 is charged up either by the power on transient START or the flame on signal from mode 153. Thus a fully latched control scheme is implemented which furthermore is fail-safe by virtue of the component functions.

Obviously many modifications and variations to the above disclosure can be made without departing from the spirit of the invention. It is therefore intended that the scope of the invention be determined solely on the claims appended hereto.

We claim:

1. An ignition assembly connected for excitation by a source of A.C. electrical signal and adapted to ignite the fuel emitted by a burner, comprising:

a high voltage spark circuit disposed to extend into said burner for igniting said fuel upon receipt of a logical combination of a first and second enabling signal;

a flame sensor disposed in said burner for producing said first enabling signal in response to the absence of a flame thereat;

valve means connected to said burner for controlling the supply of said fuel thereto;

control means connected to said valve means, said source of A.C. electrical excitation and said flame sensor for energizing said valve means to an open state in response to the first application of said electrical signal and producing said second enabling signal indicative thereof, said control means including timing means initiated by said first application of said A.C. electrical signal or said first enabling signal interposed between said valve means and said A.C. electrical signal said timing means being reset on each successive application of said A.C. electrical signal; and breaker means in circuit with said valve means and connected to said control means, said breaker means including a two position breaker switch latched open at the completion of said timing signal by the receipt of said enabling signal for as long as said ignition assembly is connected to said A.C. signal.

2. Apparatus according to claim 1 wherein:

said high voltage spark circuit includes a capacitive discharge pulse circuit adapted to produce a plurality of pulses in response to the cyclic modulations of said A.C. electrical signal upon receipt of said first and second enabling signal and a spark igniter connected to receive said pulses for producing sparks in response thereto along said burner.

3. Apparatus according to claim 2 wherein:

said control means further includes a relay in series with a switching device for applying said A.C. electrical signal to said valve means upon the closure thereof, said switching device including gating means for enabling thereof in response to said timing means or the absence of said first enabling signal.

4. Apparatus according to claim 3 wherein:

said switching device comprises a silicon controlled rectifier.

5. Apparatus according to claim 4 further comprising:

a manually articulated switch interposed on said A.C. electrical signal for producing said first application thereof in response to manual articulation.

6. Apparatus according to claim 5 further comprising:

fusing means disposed in circuit with said manual switch for opening the circuit conveying said A.C. electrical signal when said silicon controlled rectifier is shorted.

7. An electrically excited ignition circuit useful to ignite the fuel in a burner comprising:

a source of alternating electrical signal;

a manually articulated switch connected in series with said source;

a flame sensor mounted on said burner for producing a rectified electrical circuit path upon exposure to a flame;

a spark igniter mounted on said burner for producing ignition sparks in response to high voltage electrical pulses;

transformer means including a first winding connected in circuit with said manually articulated switch, a second winding connected in circuit with said sensor, and a center tapped third winding;

a capacitive discharge pulse circuit connected across one half of said third winding for producing said high voltage pulses in cyclic relationship with said A.C. signal, including gating means responsive to a combustion of a feedback signal and a signal on said second winding indicative of the absence of a flame, for selectively producing said pulse signals; and a control circuit disposed across the other half of said third winding including relay means adapted to control the flow of fuel to said burner a latch in circuit with a silicon controlled rectifier connected in circuit with said latch and producing said feedback signal at the output indicative of the conduction thereof, a gating circuit connected to the gate terminal of said silicon controlled rectifier for enabling conduction thereacross in response to a timing signal or the signal on said second winding, and timing means connected to produce said timing signal for a predetermined interval of time after the closure of said manually articulated switch or after a flame indicating signal is produced on said second winding, whereby said latch is rendered open at the completion of said timing signal.

8. Apparatus according to claim 7 further comprising:

fusing means connected in circuit with said manual switch for distrupting said A.C. signal upon the occurrence of a short in said silicon controlled rectifier.

* * * * *